United States Patent [19]

Boyd

[11] Patent Number: 4,976,030

[45] Date of Patent: Dec. 11, 1990

[54] HAIR TRIMMING APPARATUS

[76] Inventor: Alfred J. Boyd, 2 Bishops Road Upper Hale, Farnham, Surrey GU90JA, England

[21] Appl. No.: 486,291

[22] Filed: Feb. 28, 1990

[51] Int. Cl.[5] ..... B26B 19/00; B26B 21/10; B26B 21/06

[52] U.S. Cl. ..... 30/29.5; 30/48; 30/49

[58] Field of Search ..... 30/29.5, 30, 48, 49

[56] References Cited

U.S. PATENT DOCUMENTS

| | | | |
|---|---|---|---|
| 1,241,921 | 10/1917 | Carroll | 30/48 |
| 1,468,082 | 9/1923 | Ryan | 30/48 |
| 1,479,690 | 1/1924 | Angst | 30/48 |
| 1,827,041 | 10/1931 | Secrest | 30/49 |
| 1,981,958 | 11/1934 | Korree | 30/49 |
| 2,026,229 | 12/1935 | Gratiot | 30/48 |
| 2,735,174 | 2/1956 | Gyllenberg | 30/49 |

*Primary Examiner*—Douglas D. Watts
*Assistant Examiner*—Paul M. Heyrana, Sr.
*Attorney, Agent, or Firm*—Leon Gilden

[57] ABSTRACT

An apparatus including a cylindrical longitudinally aligned handle including a cutting head pivotally mounted at an upper end thereof onto a reduced shank of the handle to permit spaced parallel alignment overlying the handle, wherein the cutting head includes an arcuate upper surface with coextensive cutting edges mounted adjacent the bottom surface of the cutting head. An abutment bar is pivotally mounted to a bottom surface of the cutting head limiting penetration of the cutting head within a nostril cavity of an individual utilizing the organization.

1 Claim, 4 Drawing Sheets

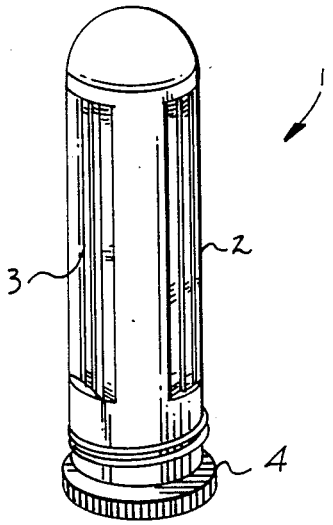
FIG 1
PRIOR ART
FIG 2
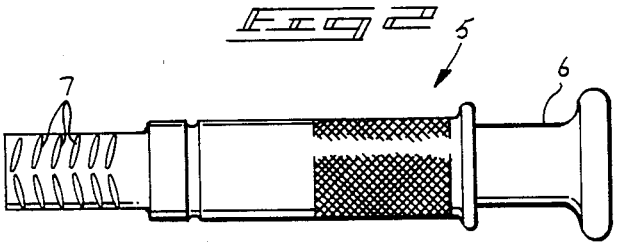
PRIOR ART

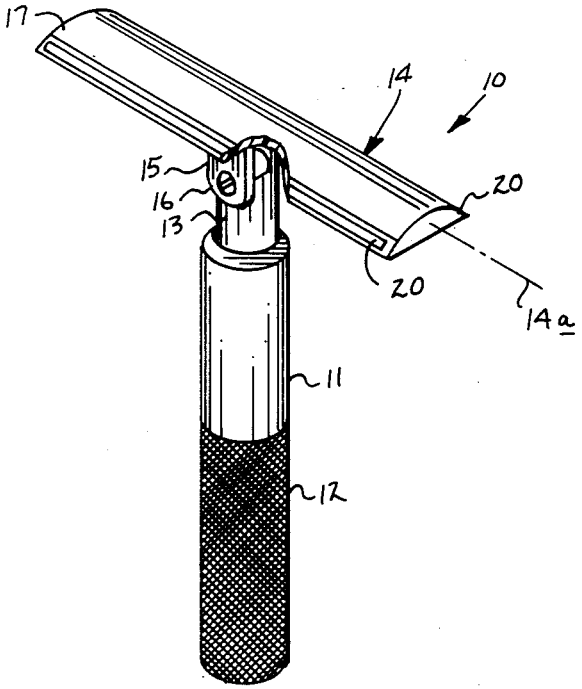
FIG 3
FIG 4
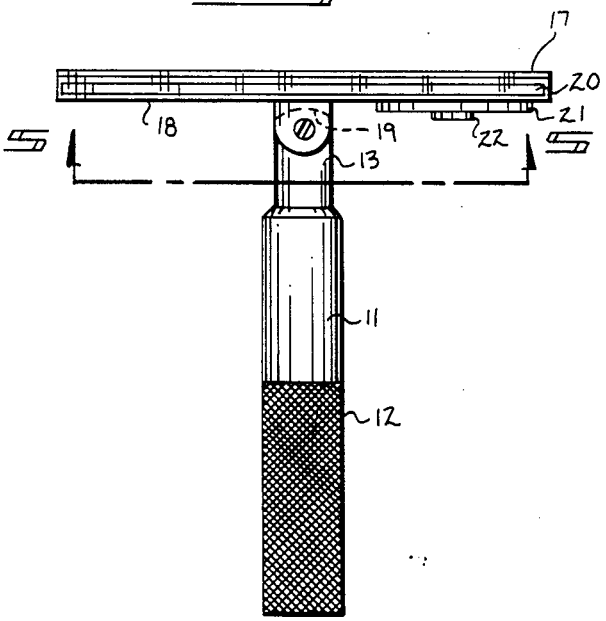

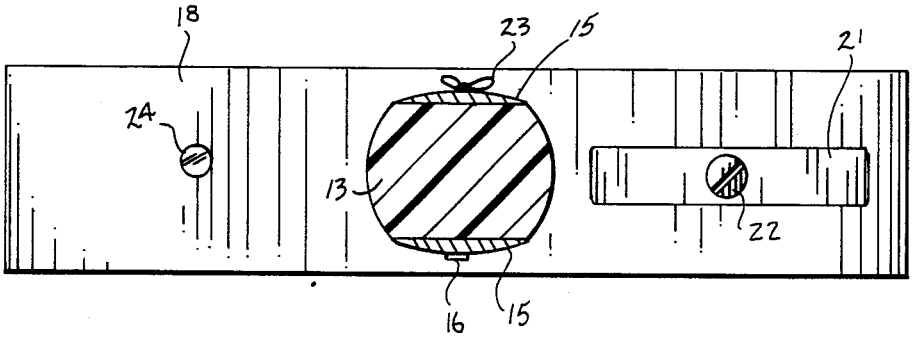
FIG 5
FIG 6
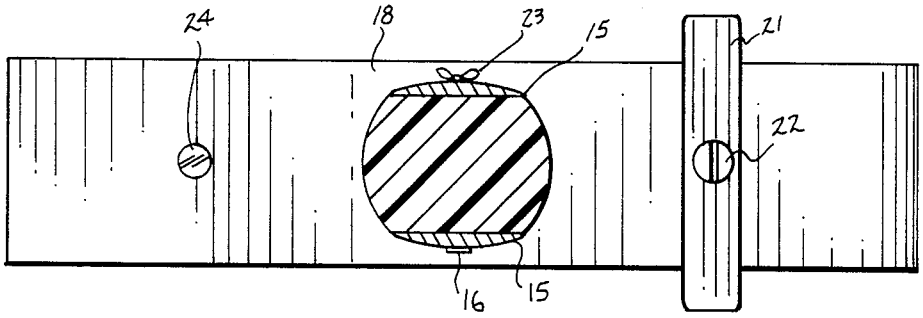

HAIR TRIMMING APPARATUS

BACKGROUND OF THE INVENTION

1 . Field of the Invention

The field of invention relates to hair trimming apparatus, and more particularly pertains to a new and improved hair trimming apparatus wherein the same is utilized in a shaving procedure, or alternatively utilized for trimming of nostril hair.

2. Description of the Prior Art

The prior art has utilized various organizations for trimming of nostril hair and the like, but has heretofore failed to provide a trimming and shaving apparatus which selectively permits the trimming of nostril hair or its utilization in a conventional shaving procedure permitted by the pivotment of the cutting head relative to its handle. Examples of the prior art include U.S. Pat. No. 4,439,794 to Miller wherein a cutting head of a generally cylindrical configuration utilizes spaced blades mounted coaxially parallel relative to the axis of the organization permitting insertion within a nostril and upon rotation of the organization permits trimming of such hair within the nostril.

U.S. Pat. No. 2,686,965 to Lipman sets forth a hair clipper utilizing a cylindrical tube formed with slots, with a cutting head mounted reciprocatably within the tube, whereupon telescoping of the cutting head within the tube, nostril hair is severed between the slots and the cutting head.

U.S. Pat. No. 3,299,507 to Mistretta illustrates the use of a cylindrical razor apparatus wherein internal cutting blades are mounted in a predetermined orientation relative to the organization to permit trimming of beards and the like.

U.S. Pat. No. 3,534,473 to Neeley sets forth a hair clipping apparatus wherein the same includes coaxially projecting cutters mounted forwardly of a cylindrical housing projected within a nostril for severing of nostril hairs and the like.

U.S. Pat. No. 3,574,936 to Bullerman sets forth a razor sandwiched between spaced comb-like members to remove hair from nose and ear cavities.

As such, it may be apprieciated that there continues to be a need for a new and improved hair trimming apparatus wherein the same addresses both the problems of ease of use, as well as effectiveness in construction in permitting selective trimming of hair from nostril and ear cavities of an individual and in this respect, the present invention substantially fulfills this need.

SUMMARY OF THE INVENTION

In view of the foregoing disadvantages inherent in the known types of hair trimming apparatus now present in the prior art, the present invention provides a hair trimming apparatus wherein the same permits selective trimming of hair from nostril and ear cavities. As such, the general purpose of the present invention, which will be described subsequently in greater detail, is to provide a new and improved hair trimming apparatus which has all the advantages of the prior art hair trimming apparatus and none of the disadvantages.

To attain this, the present invention provides an apparatus including a cylindrical longitudinally aligned handle including a cutting head pivotally mounted at an upper end thereof onto a reduced shank of the handle to permit spaced parallel alignment overlying the handle, wherein the cutting head includes an arcuate upper surface with coextensive cutting edges mounted adjacent the bottom surface of the cutting head. An abutment bar is pivotally mounted to a bottom surface of the cutting head limiting penetration of the cutting head within a nostril cavity of an individual utilizing the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the sprirt and scope of the present invention.

Further, the purpose of the foregoing abstract is to enable the U. S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hair trimming apparatus which has all the advantages of the prior art hair trimming apparatus and none of the disadvantages.

It is another object of the present invention to provide a new and improved hair trimming apparatus which may be easily and efficiently manufactured and marketed.

It is a further object of the present invention to provide a new and improved hair trimming apparatus which is of a durable and reliable construction.

An even further object of the present invention is to provide a new and improved hair trimming apparatus which is susceptible of a low cost of manufacture with regard to both materials and labor, and which accordingly is then susceptible of low prices of sale to the consuming public, thereby making such hair trimming apparatus economically available to the buying public.

Still yet another object of the present invention is to provide a new and improved hair trimming apparatus which provides in the apparatuses and methods of the prior art some of the advantages thereof, while simultaneously overcoming some of the disadvantages normally associated therewith.

Still another object of the present invention is to provide a new and improved hair trimming apparatus providing a cutting head pivotally mounted to a medially mounted handle member, wherein pivotment of the head relative to the handle member permits selective shaving or trimming of hair from within nostril and ear cavities.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art nostril trimming apparatus.

FIG. 2 is an orthographic side view taken in elevation of a further prior art nostril trimming device.

FIG. 3 is an isometric illustration of the instant invention.

FIG. 4 is an orthographic side view taken in elevation of the instant invention.

FIG. 5 is an orthographic view taken along the lines 5—5 fo FIG. 4 in the direction indicated by the arrows.

FIG. 6 is a bottom orthographic view as set forth in FIG. 5 with the abutment member in a rotated second position to prevent unnecessary entry of the cutting head into an associated nostril or ear cavity.

DESCRIPTION OF THE PREFERRED EMBODIMENT

Figure 7:
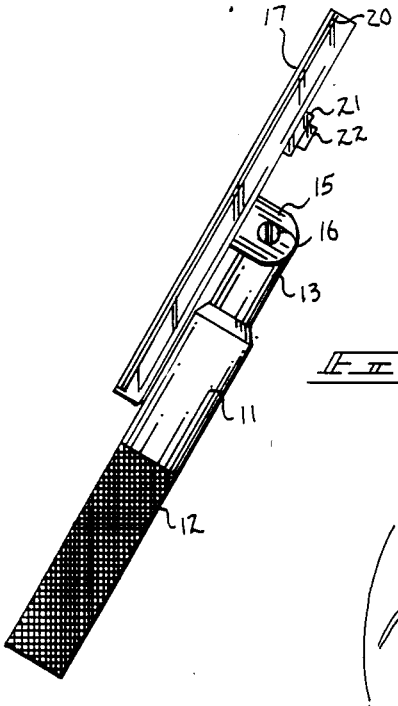
FIG. 7 is an orthographic side view taken in elevation of the instant invention in position to permit entry within a nostril cavity.
Figure 8:
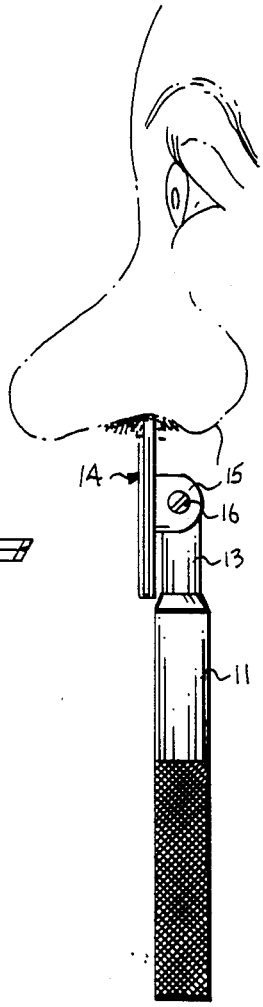
FIG. 8 is an orthographic side view taken in elevation of the instant invention in use.

With reference now to the drawings, and in particular to FIGS. 1 to 8 thereof, a new and improved hair trimming apparatus embodying the principles and concepts of the present invention and generally designated by the reference numeral 10 will be described.

FIG. 1 illustrates a prior art nostril trimming type device 1, including a cylindrical body 2 containing a series of blades 3 mounted within recesses of the body 2, whereupon rotation of the handle 4, the blades 3 effect a trimming operation within a nostril cavity. FIG. 2 illustrates a further device 5 including a plunger 6 mounted to a cylindrical body that includes a series of slots 7 at a forwardmost end thereof. Upon reciprocation of the plunger 6, an internal cutting head mounted underlying the slots 7 is directed past the slots to effect a hair cutting operation.

More specifically, the hair trimming apparatus 10 of the instant invention essentially comprises a longitudinally aligned cylindrical handle 11, including a knurled handle portion 12 formed about a lower half of the surface of the handle 11. A support shank 13 is coaxially aligned and directed upwardly of an upper end of the handle 11 and is of a diameter substantially less than that of the handle 11 pivotally mounting a cutter head 14 thereon. The cutter head 14 is defined by a longitudinal axis 14*a* that includes spaced legs 15 orthogonally and integrally mounted medially of a planar bottom surface 18 of the cutter head 14 to permit pivotment of the cutter head 14 about a fastener 16 and its associated axis, wherein the fastener 16 is directed through the spaced legs 15 adjacent an upper arcuate end 19 of the support shank 13. The positioning of the fastener 16 and its associated axis adjacent the upper arcuate end 19 of the shank 13 permits parallel alignment relative to an axis defined by the handle 11, as illustrated in FIG. 7 for example. Further, the cutter head 14 is defined by a cutter head width substantially equal to the diameter of the handle 11 to define a substantially compact organization in use, and to further provide an individual utilizing the apparatus an immediate appreciation of the width and effective cutting spacing of the cutter head in use by grasping of the handle 11.

Cutter head 14 is formed with an upper arcuate top surface 17 that mounts a plurality of cutting blades 20 that are directed longitudinally and coextensively with the head 14 along the top surface 17 adjacent the bottom surface 18. Pivotally mounted to the bottom surface 18 is a longitudinally aligned abutment bar 21 defined by a predetermined length, wherein the predetermined length is substantially greater than the predetermined width of the head 14, wherein the abutment bar 21 is mounted contiguously with the bottom surface 18. The abutment bar utilizes an abutment bar fastener 22 threadedly received within an associated threaded bore mounted orthogonally into the bottom surface 18. Each bore 24 receiving the fastener 22 is spaced from an axis defined by the handle 11 and associated shank 13 a distance greater than one-half of the predetermined length of the abutment bar 21 to permit free pivotment of the abutment bar 21 abut the bottom surface 18. Two such threaded bores 24 are mounted in diametrically opposed alignment relative to the support shank 13, whereupon an individual may reposition the abutment bar 21 to either of the threaded bores 24 to permit utilization of each end of the cutter head 14 in use as a nostril trimming tool and thereby permit utilization of each end portion of the cutting blades 20 and thereby enhance durability and longevity of the device in use. Wing nut securement member 23 threadedly receives a threaded shank of the fastener 16 and thereby upon selective tightening and loosening of the wing nut 23, permits utilization of the cutting head 14 in an orthogonal relationship relative to the handle 11 or in a parallel relationship relative thereto permitting use of the device as a shaving instrument or as a nostril and ear cavity hair trimming instrument.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A hair trimming apparatus comprising, an elongate, longitudinally aligned handle member defined by a handle member axis and defined by a first diameter, and a support shank coaxially aligned with and integrally mounted to an upper terminal end of the handle member axis defined by a second diameter less than that of the first diameter, and a longitudinally aligned cutting head defined by a cutting head axis mounted to the support shank and pivotal about a pivot axis oriented transversely relative to the handle member axis, and wherein the cutting head is pivotal from a first position, wherein the cutting head axis is oriented orthogonally relative to the handle member axis to a second position wherein the cutting handle axis is arranged parallel to the handle member axis and spaced therefrom, and wherein the cutting head includes an arcuate top surface and a planar bottom surface, the planar bottom surface including a plurality of spaced legs, with a threaded fastener member directed through the spaced legs, and an upper end of the support shank to pivotally and transversely orient the fastener relative to the cutting head axis, and wherein the fastener includes an internally threaded wing nut mounted to the threaded fastener to clampingly secure the cutting head in the first and second positions selectively, and wherein the cutting head further including an abutment bar, the abutment bar defined by an abutment bar length, and the cutting head defined by a cutting head width, wherein the abutment bar length is greater than that defined by the cutting head width, and the abutment bar is contiguously mounted adjacent the bottom surface of the cutting head and includes a fastener directed through the abutment bar and received within a first threaded bore, and including a second threaded bore, the first and second threaded bores spaced diametrically opposed to one another relative to the support shank and spaced from the support shank a distance greater than one-half of the abutment bar length.

* * * * *